US005328402A

United States Patent [19]

Hallford

[11] Patent Number: 5,328,402

[45] Date of Patent: Jul. 12, 1994

[54] TOY DUMP TRAILER APPARATUS

[76] Inventor: Jon D. Hallford, 101 S. 10th St., Lamar, Colo. 81052

[21] Appl. No.: 99,468

[22] Filed: Jul. 30, 1993

[51] Int. Cl.[5] ..... A63H 17/05

[52] U.S. Cl. ..... 446/427; 446/434

[58] Field of Search ..... 446/434, 425, 426, 427, 446/428

[56] References Cited

U.S. PATENT DOCUMENTS

| | | | |
|---|---|---|---|
| 1,731,040 | 10/1929 | Blackmore | 446/427 |
| 2,751,712 | 6/1956 | Klint | 446/427 |
| 3,104,015 | 9/1963 | Goldfarb | 446/426 X |

FOREIGN PATENT DOCUMENTS

| | | | |
|---|---|---|---|
| 502520 | 5/1954 | Canada | 446/434 |
| 1442585 | 7/1976 | United Kingdom | 446/434 |

*Primary Examiner*—Mickey Yu
*Attorney, Agent, or Firm*—E. Michael Combs

[57] ABSTRACT

A toy trailer including a hopper, with the hopper including bottom wall doors pivotally mounted and arranged for closing and opening relative to cables directed to a winding axle is provided. Trailer wheels are mounted below the trailer floor, that in turn is positioned rearwardly of the trailer hopper for simulation of a bottom dump trailer organization.

A framework is provided and arranged for mounting onto and extending over the hopper. The framework includes a canopy reciprocatably mounted in the framework. Further, the trailer wheels have a support deck to optionally include lock plates slidable and selectively latched relative to the trailer floor.

6 Claims, 4 Drawing Sheets

TOY DUMP TRAILER APPARATUS

BACKGROUND OF THE INVENTION

1. Field of the Invention

The field of invention relates to toy apparatus, and more particularly pertains to a new and improved toy dump trailer apparatus wherein the same is directed to simulating an earth moving trailer structure.

2. Description of the Prior Art

Toy dump structure of various types have been indicated in the prior art for the amusement and entertainment of individuals, such as exemplified in U.S. Pat. No. 3,462,879 and U.S. Pat. No. 4,429,888.

The instant invention attempts to overcome deficiencies of the prior art by providing for a trailer structure per se directed to the simulation of a bottom dump trailer as employed in earth moving equipment and in this respect, the present invention substantially fulfills this need.

SUMMARY OF THE INVENTION

In view of the foregoing disadvantages inherent in the known types of toy apparatus now present in the prior art, the present invention provides a toy dump trailer apparatus wherein the same includes a trailer structure having a bottom dumping hopper for simulation of an earth moving trailer. As such, the general purpose of the present invention, which will be described subsequently in greater detail, is to provide a new and improved toy dump trailer apparatus which has all the advantages of the prior art toy apparatus and none of the disadvantages.

To attain this, the present invention provides a toy trailer including a hopper, with the hopper including bottom wall doors pivotally mounted and arranged for closing and opening relative to cables directed to a winding axle. Trailer wheels are mounted below the trailer floor, that in turn is positioned rearwardly of the trailer hopper for simulation of a bottom dump trailer organization.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved toy dump trailer apparatus which has all the advantages of the prior art toy apparatus and none of the disadvantages.

It is another object of the present invention to provide a new and improved toy dump trailer apparatus which may be easily and efficiently manufactured and marketed.

It is a further object of the present invention to provide a new and improved toy dump trailer apparatus which is of a durable and reliable construction.

An even further object of the present invention is to provide a new and improved toy dump trailer apparatus which is susceptible of a low cost of manufacture with regard to both materials and labor, and which accordingly is then susceptible of low prices of sale to the consuming public, thereby making such toy dump trailer apparatus economically available to the buying public.

Still yet another object of the present invention is to provide a new and improved toy dump trailer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
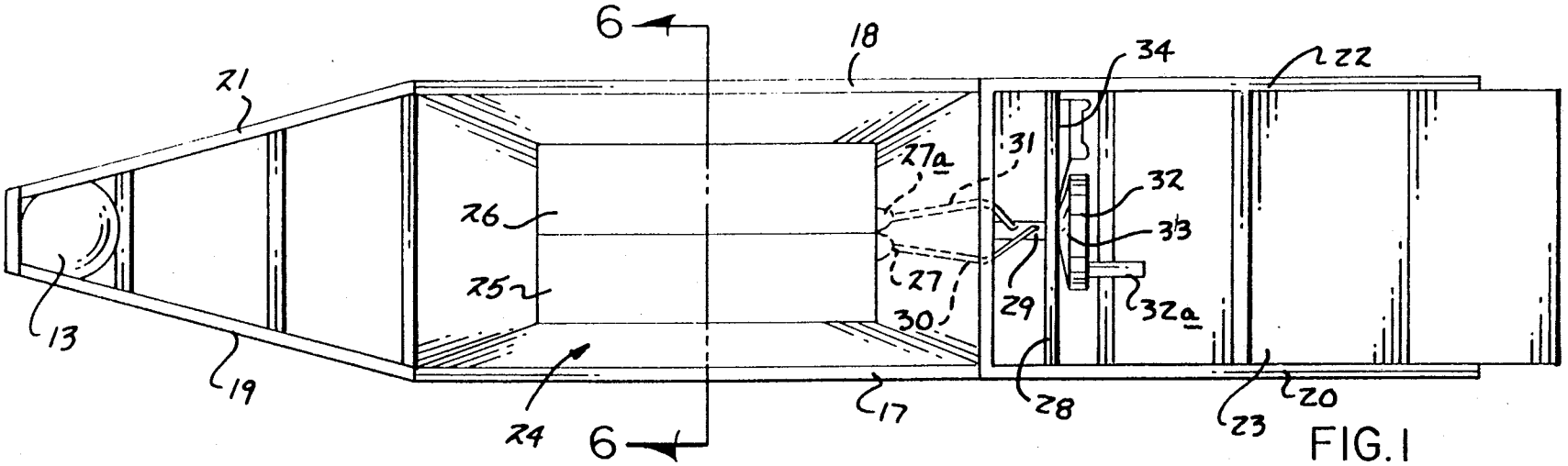
FIG. 1 is an orthographic top view of the invention.

With reference now to the drawings, and in particular to FIGS. 1 to 7 thereof, a new and improved toy dump trailer apparatus embodying the principles and concepts of the present invention and generally designated by the reference numeral 10 will be described.

Figure 2:
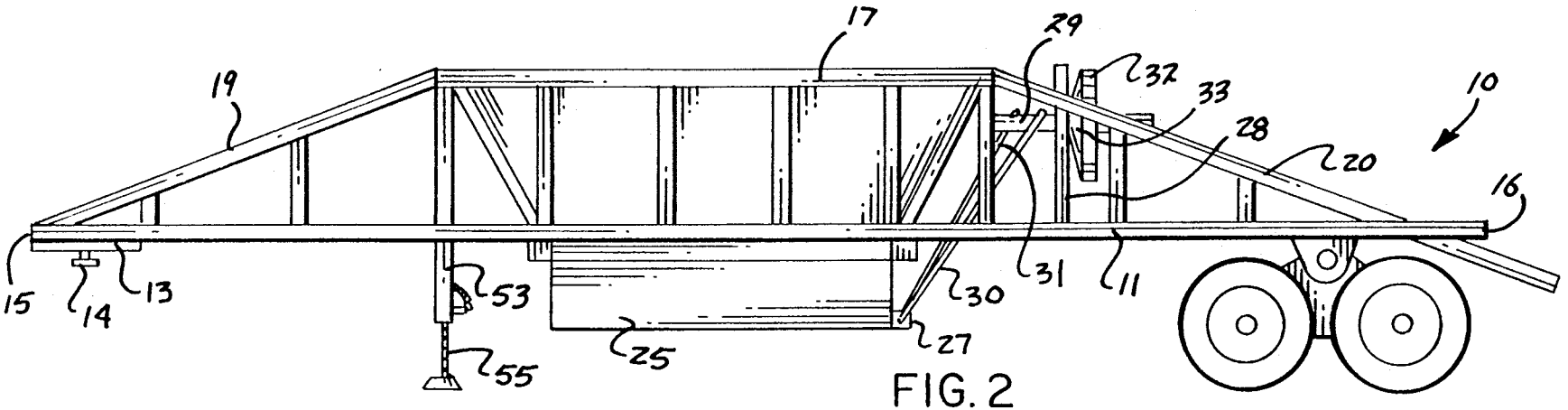
FIG. 2 is an orthographic side view of the invention.
Figure 6:
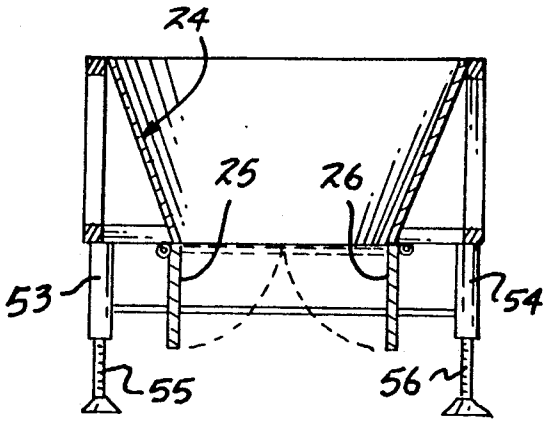
FIG. 6 is an orthographic view, taken along the lines 6—6 of FIG. 5 in the direction indicated by the arrows.

More specifically, the toy dump trailer apparatus 10 of the instant invention essentially comprises a first base leg 11 spaced from, parallel to, and coextensive with a second base leg 12. A mounting plate 13 is accordingly secured to the first and second base legs 11 and 12 at the trailer first end 15 that is spaced from the trailer second end 16, with the first and second base legs 11 and 12 including extension portions canting towards one another, as indicated, for merging to the mounting plate. A central first leg 17 is spaced from and parallel a central second leg 18, that in turn are spaced above respective first and second base legs 11 and 12 in a parallel relationship to mount a hopper 24. Central first and second first extension legs 19 and 20 respectively are canted from the central first and second legs 17 and 18 towards the mounting plate 13 in a triangular configuration, as illustrated in FIG. 2 for example, for strength and integrity to the organization in use, wherein central first and second leg second extension legs 20 and 22 extend from the central first and second legs 17 and 18 canting towards the trailer second end 16. A floor plate 23 in this manner is fixedly mounted between the first and second base legs 11 arid 12 below the central first and second leg second extension leg portions 20 and 22. A floor plate 23 includes an axle mounting plate 28 fixedly and obliquely mounted relative to the floor plate 23, with the axle mounting plate 28 spaced from the trailer second end 16 rotatably mounting a winding axle 29 thereto. As the hopper 24 includes hopper bottom wall structure formed by a respective first and second door 25 and 26 hingedly mounted to the respective first and second side walls of the hopper, the first and second doors 25 and 26 include respective first and second door lugs 27 and 27*a* (see FIG. 1 and FIG. 2 for example), with the first and second door lugs 27 and 27*a* having respective first and second winding cables 30 and 31 extending from the respective first and second legs to the winding axle 29. In this manner, unfurling of the cables 30 and 31 from the winding axle permits the doors to open, in a manner as indicated in FIG. 2, wherein winding or furling of the cables about the winding axle 29 effects closure of the door plates as they are pivoted relative to their respective hinge structure, in a manner as indicated in FIG. 6. The winding axle 29 includes a winding wheel 32 fixedly mounted to the winding axle, that in turn is spaced but in adjacency to the axle mounting plate 28, such that the winding wheel 32 includes a conical rear wall 33 in a facing relationship relative to the axle mounting plate 28, such that a sliding wedge 34 slidably mounted along the axle mounting plate 28 is interposed between the conical rear wall 33 and the axle mounting plate 28 to latch and secure the winding wheel and thereby maintain the first and second doors in a closed orientation, as indicated in FIG. 1.

Figure 4:
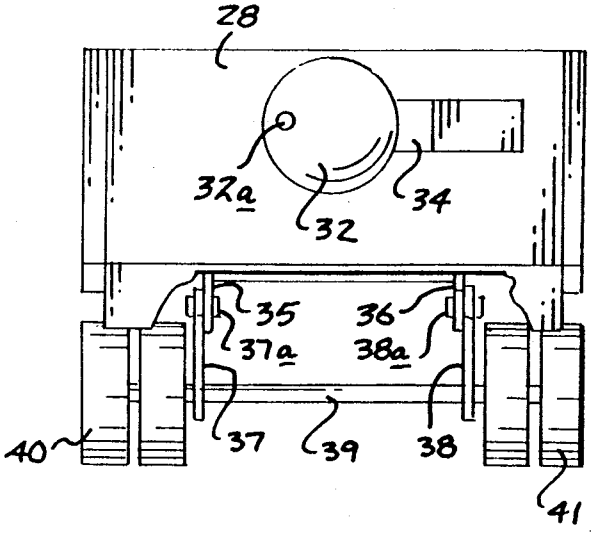
FIG. 4 is an orthographic view, taken along the lines 4—4 of FIG. 3 in the direction indicated by the arrows.
Figure 3:
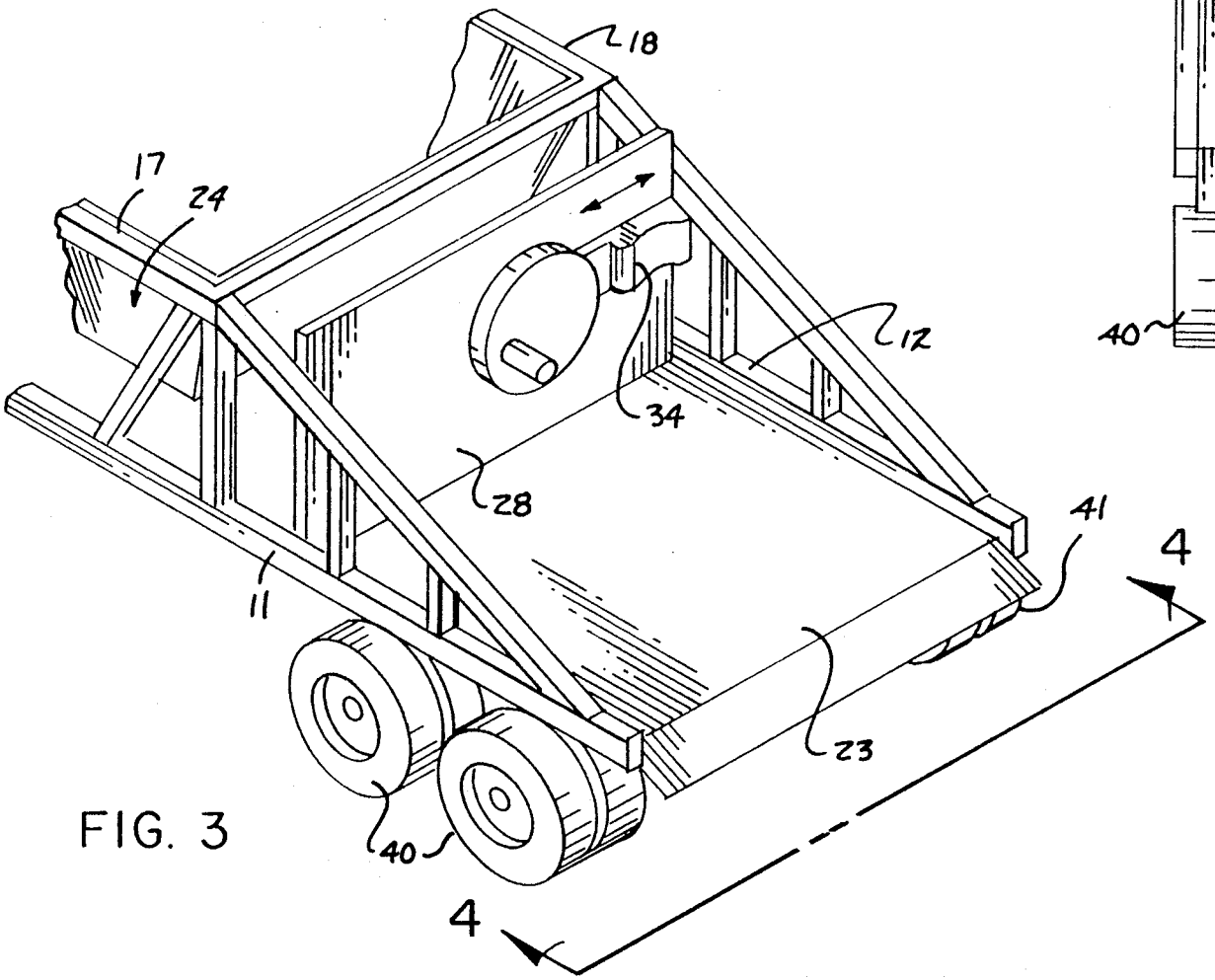
FIG. 3 is an isometric partial view of the rearwardmost portion of the trailer structure.

With reference to FIG. 4 for example indicates respective first and second flanges 35 and 36 fixedly and orthogonally mounted to a bottom surface of the floor plate 23, such that the first and second flanges 35 and 36 pivotally mount respective first and second axle plates 37 and 38 about respective first and second pin axles 37*a* and 38*a* respectively.

A rear axle 39 is orthogonally and rotatably mounted between the first and second axle plates 37 and 39 mounting respective first and second wheels 40 and 41 thereto. A plurality of such wheel axles 39 and first and second wheels 40 and 41 may be provided, as required.

Figure 5:
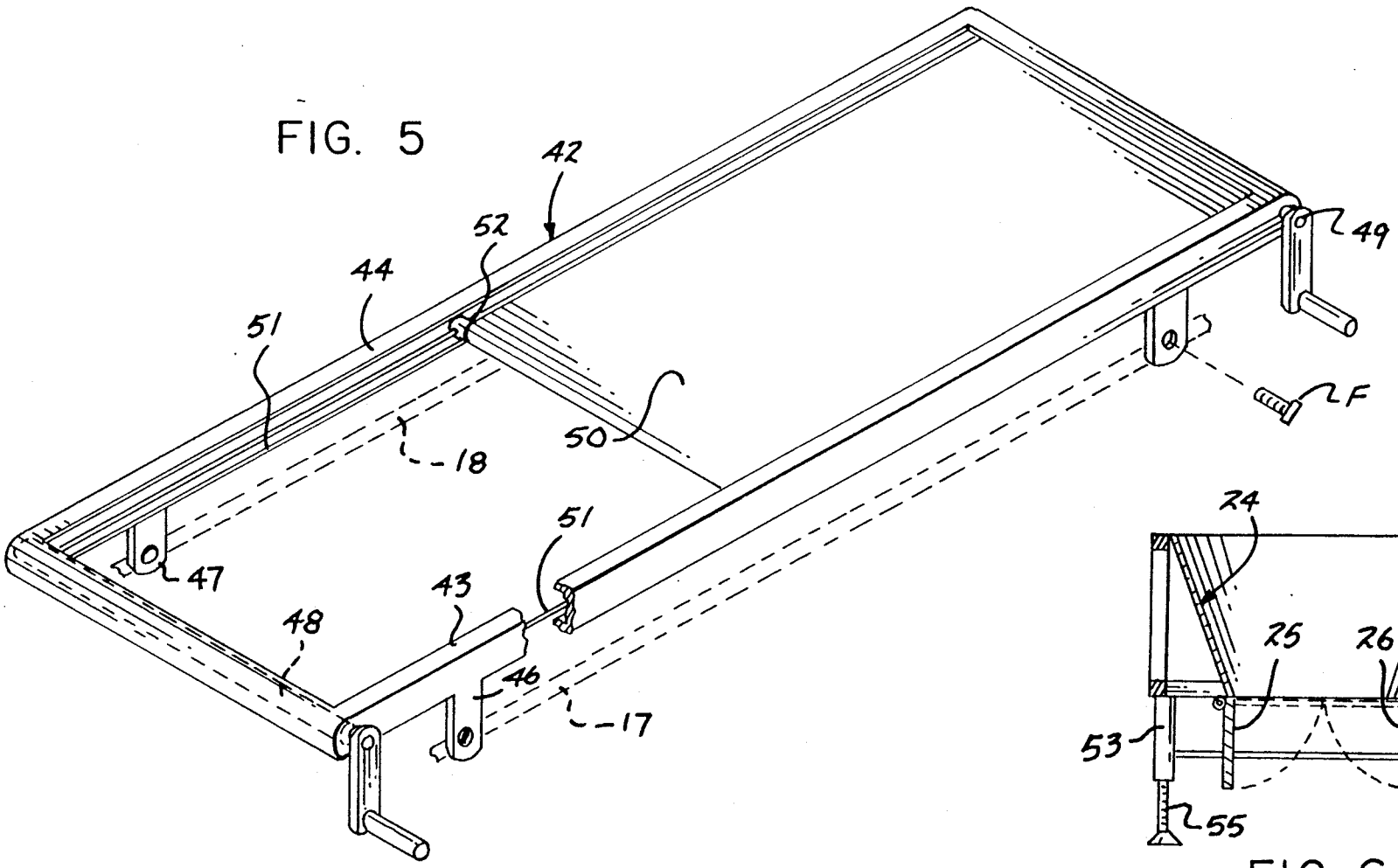
FIG. 5 is an isometric illustration of a hopper canopy structure.

The FIG. 5 indicates the use of a canopy frame 42 having canopy frame first and second legs 43 and 44 in a parallel relationship spaced apart a predetermined spacing equal to a spacing of the central first and second legs 17 and 19, such that the first and second legs 43 and 44 include respective first and second leg flanges 46 and 47 projecting therefrom arranged for securement to the respective first and second central legs 17 and 18 utilizing fasteners of any conventional type, such as illustrated by the letter "F" in the FIG. 5. Further, the canopy framework includes respective first and second winding axles 48 and 49 orthogonally and rotatably mounted between the respective canopy frames first and second legs 43 and 44 at opposite ends thereof, wherein the first winding axle 48 includes a plurality of first axle tether lines 51 extending from the first winding axle 48 to a canopy 50, that in turn includes a second winding axle 49 mounting a second end of the canopy, as the first end of the canopy includes the canopy shaft 52 receiving the first axle tether lines 51 secured thereto.

It should be noted that mounted fixedly and orthogonally relative of the first and second base legs 11 projecting therebelow in adjacency and a spaced relationship relative to the mounting plate 13 are respective first and second support tubes 53 and 54, having respective first and second telescoping legs 55 and 56 projecting therefrom, in a manner as illustrated in FIG. 6, to provide for support of the trailer structure when free-standing, in a manner as indicated in FIG. 2 for example.

Figure 7:
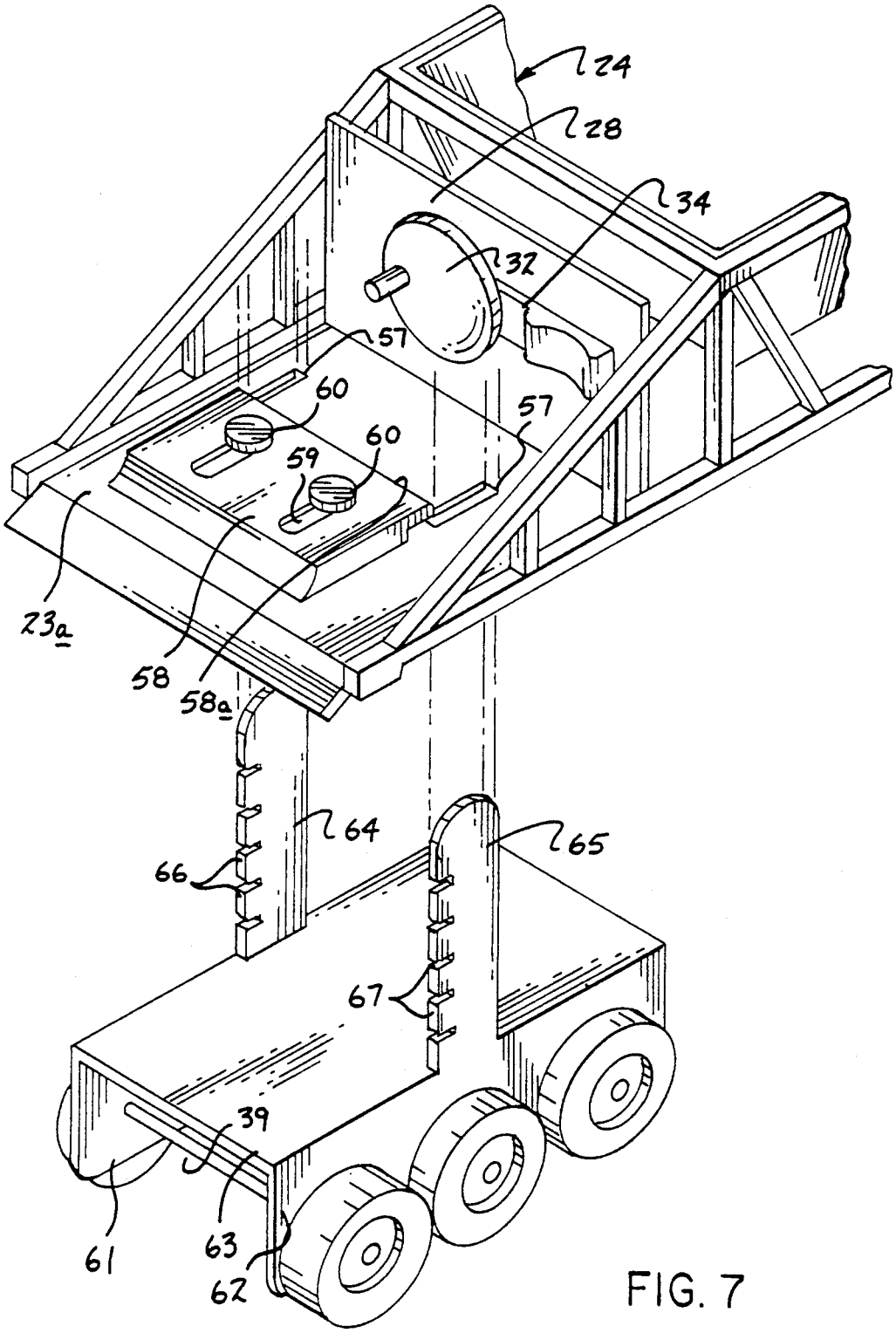
FIG. 7 is an isometric illustration of a modified wheel structure arranged for mounting to the trailer of the invention.

The FIG. 7 indicates the use of a modified floor 23*a*, having floor slots 57 that are arranged in a parallel relationship orthogonally oriented relative to the axle mounting plate 28. The modified floor 23*a* includes a lock flange 58 slidably directed there across, having a leading edge 58*a*. A plurality of lock flange slots 59 each include a fastener 60 directed through an associated lock plate slot 59 into the floor 23*a* permitting sliding of the lock plate and subsequent securement of the lock plate relative to the floor 23*a*. Wheel support first and second plates 61 and 62 mounting the respective first and second wheels about the aforenoted wheel axle structure 39 is arranged to include a wheel support deck 63, having respective first and second lock plates 64 and 65 orthogonally and fixedly mounted in a projecting relationship therefrom, wherein the first and second lock plates 64 and 65 are arranged for sliding reception through the floor slots 57. The first and second lock plates 64 and 65 include respective first and second notches 66 and 67 respectively to receive the leading edge 58*a* therewithin to provide for raising and lowering of the floor plate 23*a* relative to the deck 63.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toy dump trailer apparatus, comprising, a trailer assembly having a first end spaced from a second end, with a first base leg and a second base leg coextensive of the trailer from the first end to the second end, and a mounting plate secured to the first base leg and the second base leg adjacent the first end, with the mounting plate including a mounting boss projecting from the mounting plate, and a central first leg and a central second leg arranged in a parallel relationship relative to one another spaced above the first base leg and the second base leg respectively, with the central first leg and the central second leg spaced apart a predetermined spacing mounting a hopper between the central first leg, the central second leg, and the first base leg and the second base leg, the hopper including a hopper floor having a first door and a second door, the hopper having a first side wall and a second side wall, wherein the first door is hingedly mounted to the first side wall, the second door hingedly mounted to the second side wall, and a floor plate fixedly mounted to the first base leg and the second base leg between the hopper and the second end, with the floor plate having an axle mounting plate fixedly secured to the floor plate spaced from the second end, and a winding axle rotatably directed through the axle mounting plate, with the winding axle including a winding wheel positioned in adjacency to the axle mounting plate and fixedly secured to the winding axle, with the first door having a first lug, the second door having a second lug, a first winding cable directed from the winding axle to the first lug, and a second winding cable directed from the winding axle to the second lug permitting winding of the first winding cable and the second winding cable about the winding axle permitting securement of the first door and the second door to the hopper.

2. An apparatus as set forth in claim 1 wherein the winding wheel includes a conical rear wall in a facing adjacency to the axle mounting plate, and a sliding wedge slidably mounted along the axle mounting plate arranged for reception between the conical rear wall and the axle mounting plate to arrest movement of the winding wheel relative to the axle mounting plate.

3. An apparatus as set forth in claim 2 including a plurality of first wheels and a plurality of second wheels, and each of said first wheels and each of said second wheels includes a wheel axle directed therebetween, and the wheel axle is positioned in adjacency to and below the floor, and mounting means for securing each wheel axle relative to said floor.

4. An apparatus as set forth in claim 3 wherein the mounting means includes a first floor slot and a second floor slot directed through said floor, wherein the first floor slot and the second floor slot are positioned in adjacency to the axle mounting plate, and a wheel support first plate spaced from a wheel support second plate, with each wheel axle directed orthogonally and rotatably through the wheel support first plate and the wheel support second plate, and a deck extending fixedly between the wheel support first plate and the wheel support second plate, and a first lock plate and a second lock plate arranged in a parallel spaced relationship relative to one another and orthogonally oriented relative to the deck projecting above the deck, with the first lock plate and the second lock plate arranged for reception through the first floor slot and the second floor slot respectively, the lock plate including first notches, the second lock plate including second notches, with the floor including a lock flange slidably directed along the floor, the lock flange including a leading edge, with the leading edge arranged for reception within one of said first notches and one of said second notches to secure the deck relative to the floor.

5. An apparatus as set forth in claim 4 wherein the lock plate includes a plurality of lock plate slots, and each of the lock plate slots includes a fastener directed therethrough, and each fastener arranged for threaded reception within the floor.

6. An apparatus as set forth in claim 5 including a canopy frame, the canopy frame having a frame first leg spaced from a frame second leg in a parallel relationship, and a first winding axle orthogonally and rotatably mounted through the first leg and the second leg, and a second winding axle spaced from and parallel the first winding axle, with the second winding axle rotatably and orthogonally directed through the first leg and the second leg, the first winding axle including a plurality of first axle tether lines, and a canopy extending between the first leg and the second leg and between the first winding axle and the second winding axle, with the canopy having a canopy shaft at a canopy first end, with the canopy shaft receiving said first axle tether lines, with the canopy second end secured to said second winding axle, and the first leg including first leg flanges, the second leg including second leg flanges, the first leg flanges and the second leg flanges are each arranged to receive a flange fastener to receive said first leg flange and said second leg flange to respective central first leg and central second leg respectively.

* * * * *